US012534964B2

(12) United States Patent
Marr et al.

(10) Patent No.: US 12,534,964 B2
(45) Date of Patent: Jan. 27, 2026

(54) DOWNHOLE SWIVEL

(71) Applicant: INNOVEX DOWNHOLE SOLUTIONS, INC., Humble, TX (US)

(72) Inventors: Graeme Thomas Marr, Humble, TX (US); Callum Morrison, Humble, TX (US)

(73) Assignee: INNOVEX DOWNHOLE SOLUTIONS, INC., Humble, TX (US)

( * ) Notice: Subject to any disclaimer, the term of this patent is extended or adjusted under 35 U.S.C. 154(b) by 16 days.

(21) Appl. No.: 18/800,313

(22) Filed: Aug. 12, 2024

(65) Prior Publication Data

US 2025/0067128 A1 Feb. 27, 2025

Related U.S. Application Data

(60) Provisional application No. 63/578,089, filed on Aug. 22, 2023.

(51) Int. Cl.
*E21B 17/05* (2006.01)

(52) U.S. Cl.
CPC ..... *E21B 17/05* (2013.01)

(58) Field of Classification Search
CPC ..... E21B 17/06; E21B 17/07; E21B 7/067
See application file for complete search history.

(56) References Cited

U.S. PATENT DOCUMENTS 3,871,449 A 3/1975 Ahlstone
5,996,712 A 12/1999 Boyd
6,244,345 B1 * 6/2001 Helms ..... E21B 7/067 166/301
6,659,203 B1 * 12/2003 Cruickshank ..... E21B 7/061 166/104
8,511,392 B2 8/2013 Howlett et al.
10,329,877 B2 6/2019 Simpson et al.
10,941,620 B2 3/2021 Hanton et al.
12,152,467 B2 * 11/2024 McCullough ..... F16D 11/10
2008/0236841 A1 10/2008 Howlett et al.
(Continued)

FOREIGN PATENT DOCUMENTS

AU 2006235740 A1 10/2006
BR PI0610594 A2 7/2010
(Continued)

OTHER PUBLICATIONS

International Search Report and Written Opinion dated Nov. 28, 2024, PCT Application No. PCT/US2024/042227, 13 pages.

*Primary Examiner* — Kipp C Wallace
(74) *Attorney, Agent, or Firm* — MH2 Technology Law Group, LLP

(57) ABSTRACT

A downhole swivel includes a housing and an inner tubular positioned at least partially within the housing. The downhole swivel also includes an engaging member coupled to or integral with an end of the inner tubular, such that the engaging member and the inner tubular are rotationally locked together. The downhole swivel also includes a rotation coupler selectively positionable relative to the engaging member. The rotation coupler has a first position in which the rotation coupler transmits torque between the housing and the inner tubular, and a second position in which the rotation coupler permits relative rotation between the housing and the inner tubular.

15 Claims, 4 Drawing Sheets

(56) References Cited

U.S. PATENT DOCUMENTS

| | | | | |
|---|---|---|---|---|
| 2011/0005769 | A1 | 1/2011 | Robichaux et al. | |
| 2017/0044843 | A1* | 2/2017 | Hanton | E21B 31/005 |
| 2017/0234081 | A1* | 8/2017 | Kirkhope | E21B 17/021 166/378 |
| 2018/0038202 | A1* | 2/2018 | Williamson | E21B 47/09 |
| 2019/0106977 | A1 | 4/2019 | Amezaga et al. | |

FOREIGN PATENT DOCUMENTS

| | | | |
|---|---|---|---|
| CA | 2604438 | A1 | 10/2006 |
| GB | 2440060 | A | 1/2008 |
| GB | 2451022 | A | 1/2009 |
| GB | 2440060 | B | 2/2009 |
| GB | 2451022 | B | 2/2010 |
| NO | 20075838 | L | 1/2008 |
| WO | 2006109090 | A2 | 10/2006 |
| WO | 2006109090 | A3 | 10/2006 |
| WO | 2013011293 | A2 | 1/2013 |

* cited by examiner

DOWNHOLE SWIVEL

CROSS-REFERENCE TO RELATED APPLICATIONS

This application claims priority to U.S. Provisional Patent Application No. 63/578,089, filed on Aug. 22, 2023, which is incorporated by reference.

BACKGROUND

Swivels are used in the oil and gas field to isolate the rotation of one section of a tubular string from another. For example, during completion of an oil or gas well, sand control screens or liners are located in the well. The screens and liners may be lowered into the well on a workstring. In extended reach drilling, or when drilling/completing tortuous wells, the workstring may be rotated to reduce friction, as available down-weight may not be sufficient to fully deploy the screen/liner to a desired depth. Such rotation can reduce drag from friction between the workstring and the wellbore, reducing the required down-weight. However, rotating the screens or liners risks damaging the screens or liners. For example, if the screen or liner sticks, buckling can occur. Thus, swivels may be used to keep the screen/liner stationary while another section of the workstring is rotated.

Moreover, in directional drilling, mud motors may be employed to rotate distal sections of the drill string relative to other, more proximal (to the surface) sections. Such swivels may be selectable, permitting the decoupling of rotation between two tubulars of the string, while the tubulars remain connected together, and then recoupling rotation, e.g., on demand.

SUMMARY

An example of a downhole swivel according to the present disclosure includes a housing, an inner tubular positioned at least partially within the housing, an engaging member coupled to or integral with an end of the inner tubular, such that the engaging member and the inner tubular are rotationally locked together, and a rotation coupler selectively positionable relative to the engaging member, the rotation coupler having a first position in which the rotation coupler transmits torque between the housing and the inner tubular, and a second position in which the rotation coupler permits relative rotation between the housing and the inner tubular.

An example of a method according to the present disclosure includes connecting a downhole swivel and a downhole actuator, deploying the downhole swivel and the downhole actuator into a well, signaling the downhole actuator to actuate, wherein signaling the downhole actuator to actuate causes the downhole actuator to move a rotation coupler of the downhole swivel from a first position to a second position, the rotation coupler in the first position rotationally locks the inner tubular and the housing together, and the rotation coupler in the second position permitting an inner tubular of the downhole swivel to rotate relative to a housing of the downhole swivel, signaling the downhole actuator to release the downhole swivel. Signaling the downhole actuator to release the swivel causes the downhole actuator to permit the rotation coupler to move to the first position.

An example of a downhole swivel according to the present disclosure includes a housing, an inner tubular positioned at least partially within the housing, an engaging member rotationally locked with the inner tubular, a rotation coupler selectively positionable relative to the engaging member, the rotation coupler having a first position in which the rotation coupler transmits torque between the housing and the engaging member, and a second position in which the rotation coupler permits relative rotation between the housing and the engaging member, and a downhole actuator configured to move the rotation coupler between the first and second positions.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
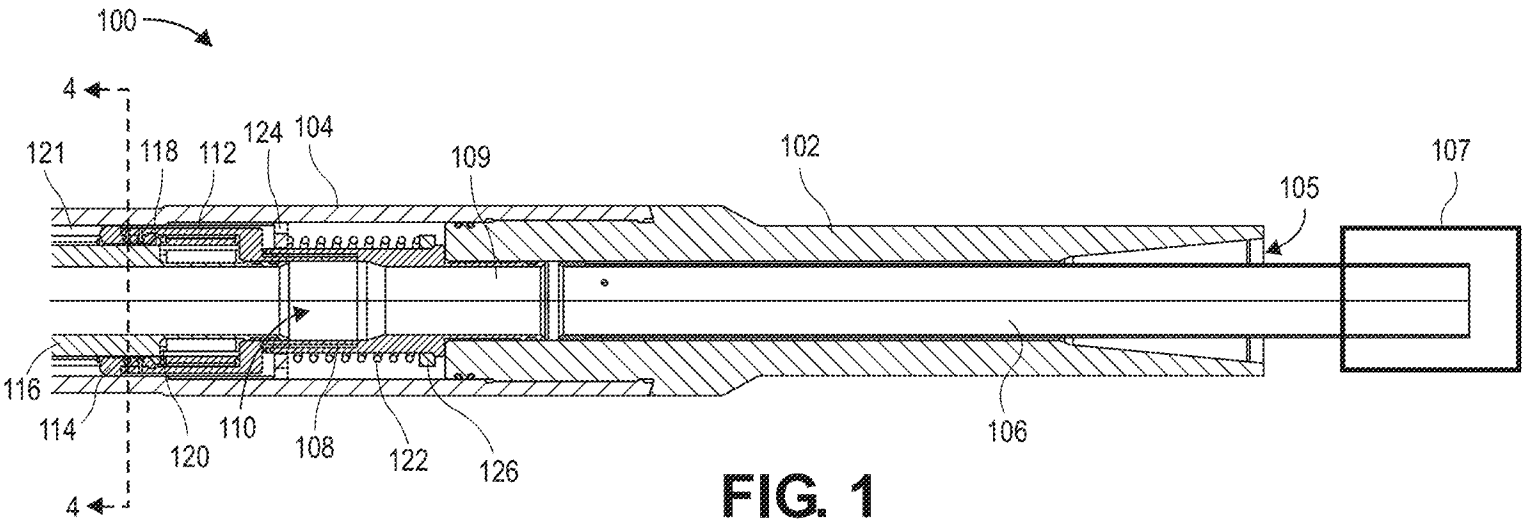
FIG. 1 illustrates a side, cross-sectional view of a downhole swivel with a rotation coupler in a first position, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms “including” and “comprising” are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, cross-sectional view of a downhole swivel 100, according to an embodiment. The swivel 100 generally includes a substantially cylindrical housing, which may be made of two or more separate housing pieces that are connected together e.g., as shown, a lower housing 102 and an upper housing 104. In this embodiment, the lower and upper housings 102, 104 may be coupled together and rotationally locked together. The lower housing 102 may include a through-bore 105, in which an actuation tubular 106 is positioned. The actuation tubular 106 may be coupled to or otherwise movable by a downhole actuator 107.

The downhole actuator 107 may be, for example, a hydraulic actuator that applies an axial force that causes the actuation tubular 106 to move linearly in the axial direction. For example, the actuator 107 may include a piston that is in a chamber containing hydraulic fluid. A control valve may control fluid flow from one side of the piston to the other, e.g., controlling the ability of the piston to move in the chamber. The piston may be connected to a mandrel. Responsive to a signal (e.g., from surface equipment), the control valve may open, permitting the piston to move in the chamber. The piston may be driven to move by pressure on the mandrel. As a result, the mandrel and the piston move in an axial direction (e.g., upward, which is to the left in FIGS. 1 and 2). The mandrel may press (either directly or via one or more intermediary components) against the actuation tubular 106, causing the actuation tubular 106 to move linearly in an axial direction (e.g., toward the left in this view). Other examples of the actuator 107 may include a solenoid or any other linear or rotational actuator.

In at least some embodiments, the actuator 107 may be integrated into the swivel 100, rather than or in addition to being provided as a separate component. For example, the actuator 107 may be or include a piston, solenoid, or another actuator contained at least partially within the lower housing 102, the upper housing 104, or both. In such an embodiment, the actuation tubular 106 may be omitted.

The swivel 100 may include a rotation coupler 108, which may be positioned in the upper housing 104. The rotation coupler 108 may include a main body 109 defining a bore 110 therethrough. The bore 110 may permit fluid communication from the upper housing 104 to the bore 105 of the lower housing 102, as well as the actuation tubular 106 therein. In the illustrated position, the main body 109 is separated axially apart from the actuation tubular 106, but in other embodiments, the main body 109 and the actuation tubular 106 may be in engagement, even prior to actuation, as will be discussed below. In embodiments in which the actuator tubular 106 is omitted, the actuator 107 is integrated into the swivel 100, and the actuator 107 may act directly on the rotation coupler 108.

The rotation coupler 108 may also include a set of fingers 112. The fingers 112 may extend axially and radially outward from the main body 109 of the rotation coupler 108. The fingers 112 may be separated circumferentially apart, leaving a space for splines therebetween, as will be discussed below. Additionally, the fingers 112 may have heads 114, which may be configured to engage and disengage from such splines.

The swivel 100 may further include an inner tubular 115 (shown in FIG. 2) positioned in the upper housing 104. An engaging member 116 may be coupled to an end of the inner tubular 115, such that the inner tubular 115 and the engaging member 116 are rotationally locked together. Further, the engaging member 116 may have splines 118 extending along a portion of its outer diameter surface, e.g., generally from a shoulder 120 thereof. The engaging member 116 may be received into the rotation coupler 108, as shown, such that a portion of the engaging member 116 extends into the bore 105, while another portion is received radially within the fingers 112. As shown in FIG. 1, the heads 114 may be received between the splines 118, such that the rotation coupler 108 transmits torque between the upper housing 104 and the inner tubular/engaging member 115, 116. When, as will be described below, the rotation coupler 108 is forced to move axially relative to the engaging member 116 (e.g., toward the left in this view), the heads 114 may come out of engagement with the splines 118, thereby permitting free rotation between the rotation coupler 108 and the engaging member 116.

The upper housing 104 may also include splines 121, which may be axially and circumferentially aligned with the splines 118 of the of the engaging member 116. The splines 121 may extend longer axially than the splines 118. The splines 121 may be radially proximal to, but radially spaced apart (e.g., outward) from, the splines 118. Accordingly, when the heads 114 slide between the splines 118, the heads 114 are also between the splines 121, thereby transmitting torque between the engaging member 116 (and thus the inner tubular 115 to which it is rotationally locked) and the upper housing 104, which may be rotationally coupled to other structures (e.g., sections of a drill string). In some embodiments, the heads 114 may remain in contact with the splines 121 both when the heads 114 are engaging the splines 118 and when the heads 114 are moved away from the splines 118.

A biasing member 122 may be positioned between blocks 124 of the upper housing 104 and blocks 126 of the rotation coupler 108. The biasing member 122, e.g., a helical spring positioned around the main body 109, may be configured to bias the rotation coupler 108 axially away from the engaging member 116. This may hold the heads 114 in engagement with the splines 118 unless an axial force is applied that overcomes the biasing force of the biasing member 122.

In FIG. 1, the rotation coupler 108 is in a first position, which transmits torque. In this embodiment, the heads 114 are between and engaging the splines 118, 121, rotationally locking the engaging member 116 and the upper housing 104. For example, in the first position, the heads 114 are interleaved among the respective sets of splines 118, 121 so as to transmit torque therebetween.

Figure 2:
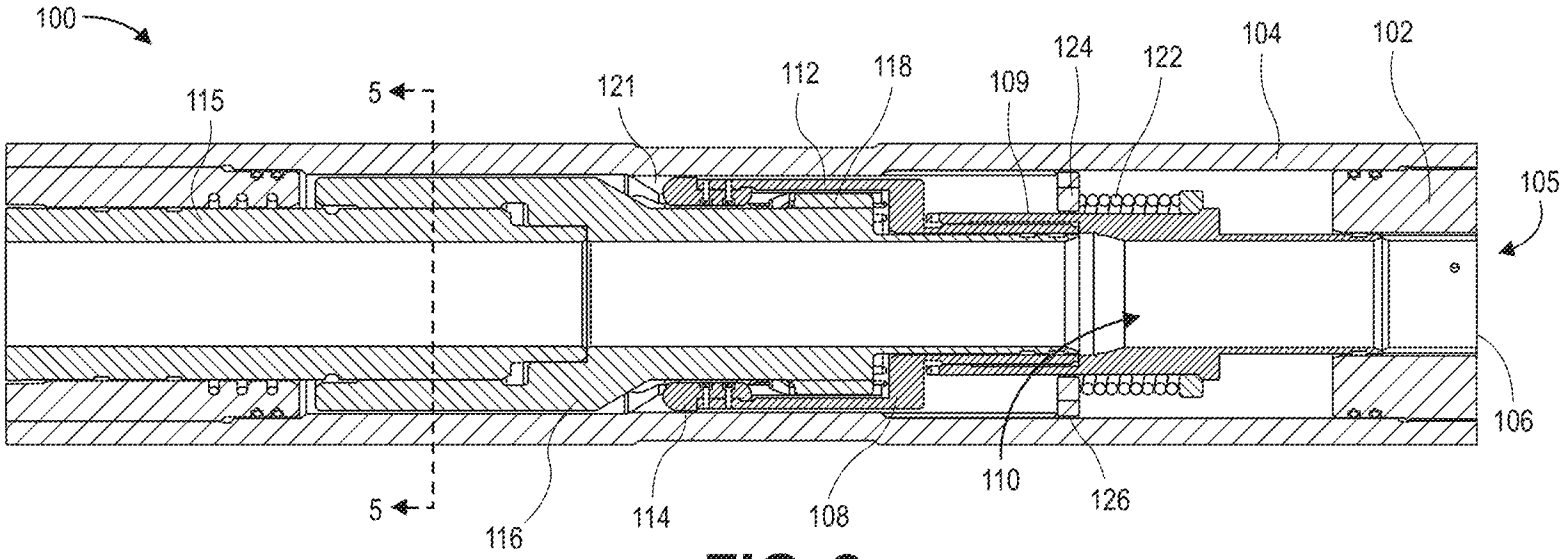
FIG. 2 illustrates a side, cross-sectional view of the downhole swivel with a rotation coupler in a second position, according to an embodiment.

FIG. 2 illustrates a side, cross-sectional view of the swivel 100 with the rotation coupler 108 in a second position, according to an embodiment. As shown, the biasing member 122 has been compressed (e.g., upward, which is to the left in FIG. 2) as the rotation coupler 108 is forced toward the engaging member 116. Such linear, axial force is applied by the actuation tubular 106, e.g., via a linear, axial force applied by the actuator 107. In this position, the heads 114 are displaced from the splines 118, although the heads 114 may remain between the splines 121. As such, the inner tubular 115 and the upper housing 104 are free to rotate relative to one another, as the rotation coupler 108 does not transmit substantial torque (e.g., no torque other than incidental friction) between the inner tubular 115 and the upper housing 104.

Although an embodiment of the rotation coupler 108 in which axial, linear movement provides the selectability of the rotational engagement, other possibilities are considered herein. For example, the actuator 107 moving the actuation tubular 106 linearly may extend lugs/dogs in the rotation coupler 108 that may engage holes or grooves formed in the inner tubular 115 and/or upper housing 104, such that torque is transmitted therebetween. In another embodiment, axially-extending lugs may be pushed into engagement axially by the movement of the actuation tubular 106. Further, the actuator 107 may be rotational, such that the rotation coupler 108 may be actuated by rotation of the actuation tubular 106 so as to engage splines, extend lugs, etc.

Figure 3:
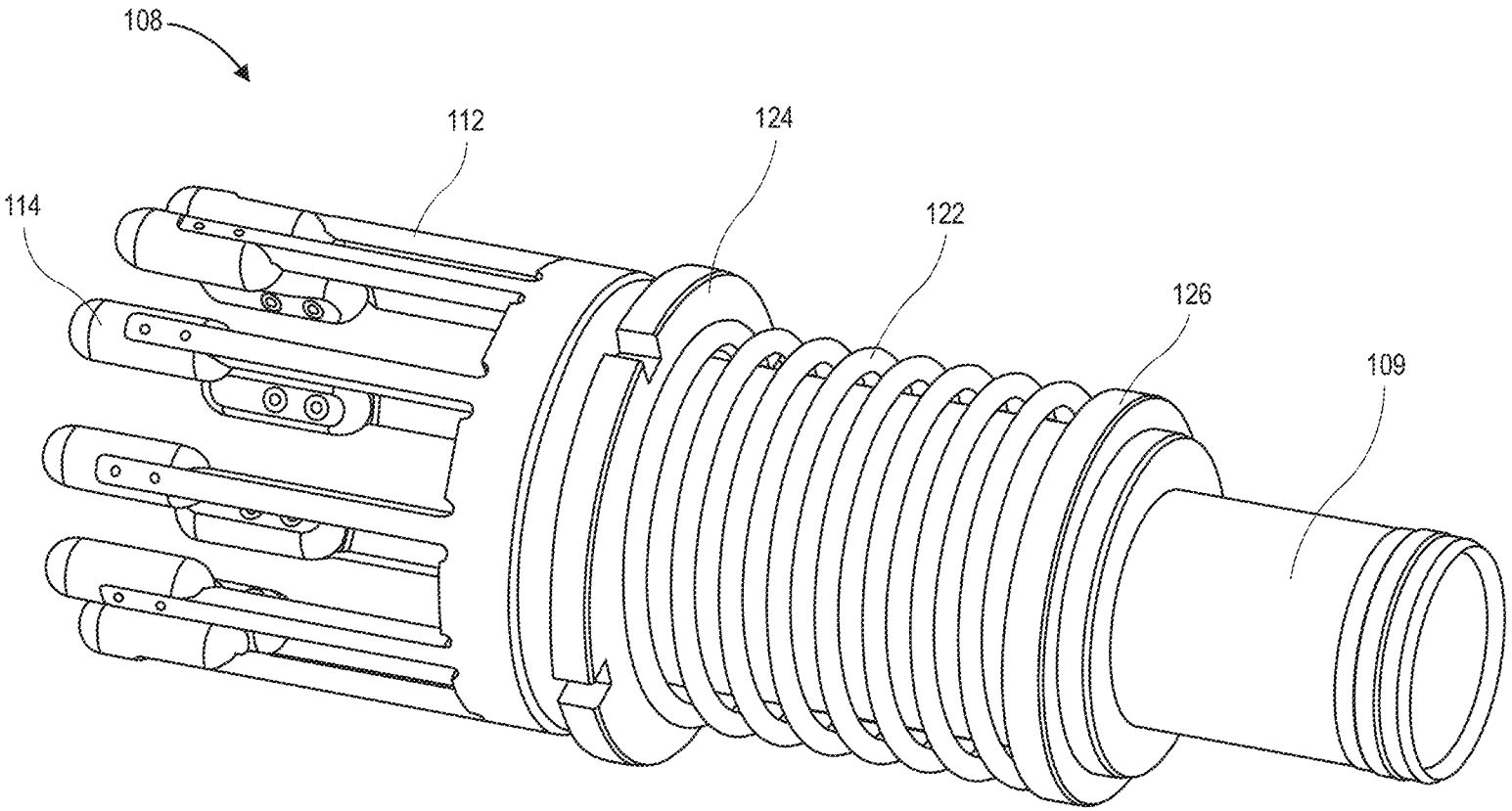
FIG. 3 illustrates a perspective view of the rotation coupler, according to an embodiment.

FIG. 3 illustrates a perspective view of the rotation coupler 108, according to an embodiment. As shown, the rotation coupler 108 includes the main body 109, about which the biasing member 122 is received. Further, the biasing member 122 is axially between the blocks 124, 126, with the block 124 being part of or connected to (e.g., abutting against a shoulder of) the upper housing 104 (e.g., FIG. 1).

The fingers 112 extend radially outward and axially away from the main body 109. The fingers 112 are separated circumferentially apart and terminate with the heads 114. The fingers 112 and the heads 114 may fit between the splines 118, 121 as discussed above, providing selective torque transmission between the inner tubular 115 and the upper housing 104, according to an embodiment.

Figure 4:
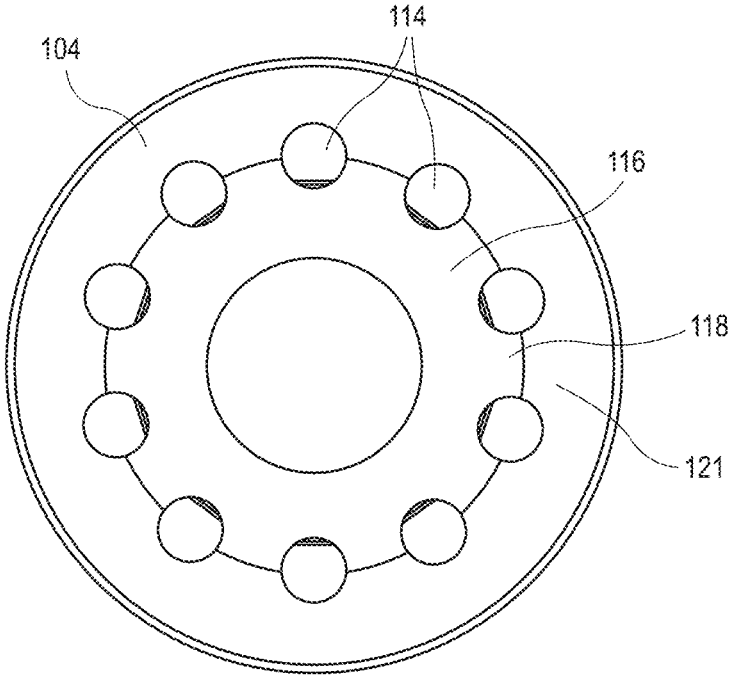
FIG. 4 illustrates an axial cross-section of the swivel, taken along line 4-4 of FIG. 1, according to an embodiment.

FIG. 4 illustrates an axial cross-sectional view of the swivel 100, as indicated by line 4-4 in FIG. 1, according to an embodiment. More particularly, this view shows the fingers 112, specifically the heads 114, positioned between the splines 118 of the engaging member 116 and the splines 121 of the upper housing 104.

Figure 5:
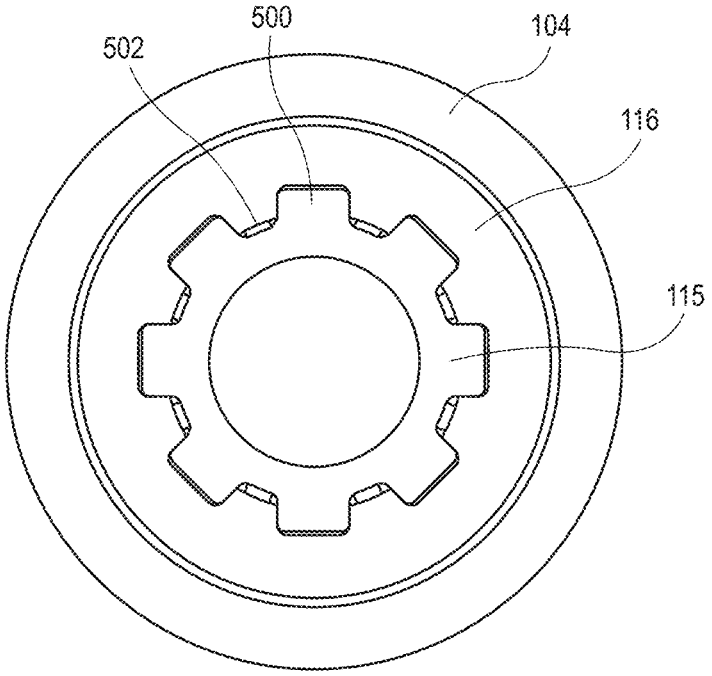
FIG. 5 illustrates an axial cross-section of the swivel, taken along line 5-5 of FIG. 2, according to an embodiment.

FIG. 5 illustrates an axial, cross-sectional view of the swivel 100, as indicated by line 5-5 in FIG. 2, according to an embodiment. As shown, the inner tubular 115 may be rotationally locked with the engaging member 116 via interleaved splines 500, 502 of the inner tubular 115 and the engaging member 116, respectively. These splines 500, 502 may remain in connection, e.g., regardless of the position of the rotation coupler 108. As also shown, the inner tubular 115 may not be directly coupled to the upper housing 104, such that the two are relatively rotatable unless the rotation coupler 108 is in the torque-transmitting position of FIG. 1.

Figure 6:
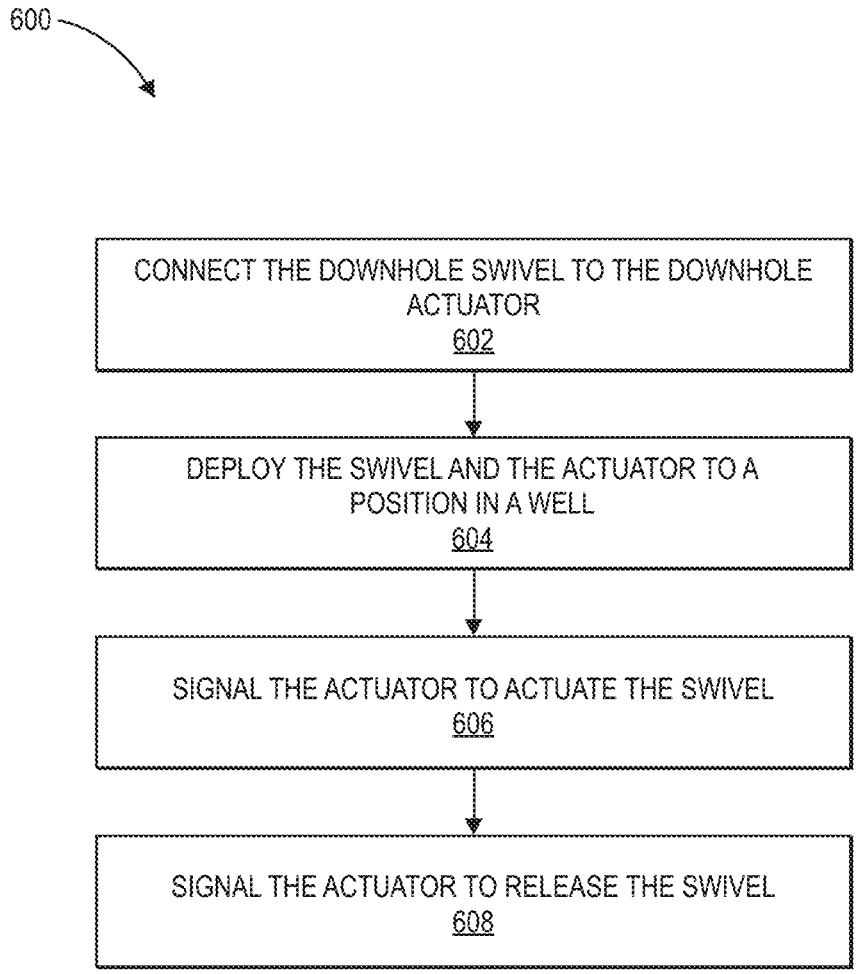
FIG. 6 illustrates a flowchart of a method for operating a downhole swivel, according to an embodiment.

FIG. 6 illustrates a flowchart of a method 600 for operating a downhole swivel, such as the swivel 100, according to an embodiment. The method 600 may include connecting the swivel 100 to the downhole actuator 107, as at 602. The method 600 may include deploying the swivel 100 and the actuator 107 to a position in a well, as at 604. The method 600 may include (e.g., hydraulically, electronically, and/or mechanically) signaling the actuator 107 to actuate the swivel 100, as at 606. The actuator 107 may, in response, actuate, e.g., drive the actuation tubular 106 to move axially relative to the swivel 100, as described above. As also described above, such actuation may actuate the swivel 100 from the first (e.g., torque transmitting) position as shown in FIG. 1 into the second (e.g., free-rotating) position as shown in FIG. 2, which may permit the inner tubular 115 to rotate relative to the upper housing 104.

The method 600 may also include signaling the actuator 107 to release the swivel 100, as at 608. In response, the actuator 107 may cease actuating. This may permit, for example, the biasing member 122 to force the rotation coupler 108 away from the engaging member 116, which may slide the heads 114 into engagement with the splines 118. In turn, such engagement results in the heads 114 being engaged with both the splines 118 and the splines 121, such that the rotation coupler 108 rotationally locks the upper housing 104 with the inner tubular 115, transmitting torque therebetween. As noted above, the axial actuation of the actuation tubular 106 is merely one example, and actuation may instead be rotational. Further, radially (or axially) extending lugs or dogs, for example, may be used instead of or in addition to the fingers 112 of the embodiment illustrated in FIGS. 1-5.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole swivel, comprising:

a housing;

an actuation tubular that extends out of the housing and is engageable with a downhole actuator;

an inner tubular positioned at least partially within the housing;

an engaging member coupled to or integral with an end of the inner tubular, such that the engaging member and the inner tubular are rotationally locked together;

a rotation coupler selectively positionable relative to the engaging member, the rotation coupler having a first position in which the rotation coupler transmits torque between the housing and the inner tubular, and a second position in which the rotation coupler permits relative rotation between the housing and the inner tubular; and a biasing member configured to bias the rotation coupler axially away from the inner tubular and toward the first position.

2. The downhole swivel of claim 1, wherein, when the rotation coupler is in the second position, the rotation coupler does not transmit substantial torque between the inner tubular and the housing, such that the inner tubular and the housing are free to rotate relative to one another.

3. The downhole swivel of claim 1, wherein the actuation tubular is configured to move axially in response to a force applied by the downhole actuator, and wherein the rotation coupler moves between the first and second positions responsive to the axial movement of the actuation tubular.

4. The downhole swivel of claim 1, wherein:

the engaging member comprises first splines;

the housing comprises second splines that are axially and circumferentially aligned with the first splines and spaced radially outward therefrom; and the rotation coupler comprises fingers having heads that fit between adjacent pairs of the first splines and adjacent pairs of the second splines, when the rotation coupler is in the first position, such that torque is transmitted between the engaging member and the housing via the heads.

5. The downhole swivel of claim 4, wherein the heads are axially separated from the first splines when the rotation coupler is in the second position.

6. The downhole swivel of claim 1, wherein the housing comprises an upper housing that is configured to transmit torque to the inner tubular via the rotation coupler, and a lower housing connected to the upper housing.

7. The downhole swivel of claim 1, wherein the downhole actuator is coupled to the housing and configured to move the rotation coupler between the first and second positions.

8. A method, comprising:

connecting a downhole swivel and a downhole actuator;

deploying the downhole swivel and the downhole actuator into a well;

signaling the downhole actuator to actuate, wherein signaling the downhole actuator to actuate causes the downhole actuator to move a rotation coupler of the downhole swivel from a first position to a second position, wherein the rotation coupler in the first position rotationally locks an inner tubular of the downhole swivel and a housing of the downhole swivel together, wherein the rotation coupler in the second position permits the inner tubular to rotate relative to the housing, wherein the rotation coupler comprises fingers, the inner tubular comprises an engaging member having splines, and the housing comprises splines that are axially and circumferentially aligned with the splines of the engaging member, wherein the fingers are between the splines of the engaging member and the splines of the housing when the rotation coupler is in the first position, and wherein the fingers are not between the splines of the engaging member when the rotation coupler is in the second position; and signaling the downhole actuator to release the downhole swivel, wherein signaling the downhole actuator to release the swivel causes the downhole actuator to permit the rotation coupler to move to the first position.

9. The method of claim 8, wherein the force applied to the actuation tubular is a linear, axially-directed force, and wherein the rotation coupler moves axially from the first position to the second position in response to the force applied to the actuation tubular.

10. The method of claim 8, wherein the swivel comprises a biasing member that biases the rotation coupler linearly toward the first position.

11. The method of claim 8, wherein signaling the downhole actuator to actuate comprises sending a hydraulic signal, an electric signal, a mechanical signal, or a combination thereof.

12. A downhole swivel, comprising:

a housing having first splines;

an inner tubular positioned at least partially within the housing;

an engaging member rotationally locked with the inner tubular, wherein the engaging member comprises second splines;

a rotation coupler selectively positionable relative to the engaging member, the rotation coupler having a first position in which the rotation coupler transmits torque between the housing and the engaging member, and a second position in which the rotation coupler permits relative rotation between the housing and the engaging member, wherein the rotation coupler comprises fingers that fit between the first and second splines and transmit torque between the housing and the engaging member; and a downhole actuator configured to move the rotation coupler between the first and second positions.

13. The downhole swivel of claim 12, further comprising an actuation tubular that extends out of the housing, wherein the actuation tubular is engageable with the downhole actuator and the rotation coupler.

14. The downhole swivel of claim 12, wherein the downhole actuator is coupled to the housing and the rotation coupler.

15. The downhole swivel of claim 12, further comprising a biasing member configured to bias the rotation coupler axially away from the inner tubular and toward the first position.

* * * * *